United States Patent [19]

Izumi et al.

[11] Patent Number: 4,840,417

[45] Date of Patent: Jun. 20, 1989

[54] MOVABLE YOKE-TYPE LIFTING MAGNET DEVICE

[75] Inventors: Akira Izumi; Tomomi Kishi, both of Toyota; Hideo Niwa, Toyoake, all of Japan

[73] Assignees: Toyota Jidosha Kabushiki Kaisha, Toyota; Sanmei Denki Kabushiki Kaisha, Nagoya, both of Japan

[21] Appl. No.: 126,006

[22] Filed: Nov. 27, 1987

[30] Foreign Application Priority Data

Nov. 27, 1986 [JP] Japan ..... 61-280669

[51] Int. Cl.[4] ..... B66C 1/06; H01F 7/20

[52] U.S. Cl. ..... 294/65.5; 335/285

[58] Field of Search ..... 294/65.5, 81.22, 81.62; 335/285, 295, 286, 287

[56] References Cited

U.S. PATENT DOCUMENTS 3,968,986 7/1976 Nagata ..... 294/65.5

4,652,845 3/1987 Finkle ..... 294/65.5

FOREIGN PATENT DOCUMENTS 45-126570 4/1950 Japan .

*Primary Examiner*—James B. Marbert

*Attorney, Agent, or Firm*—Cushman, Darby & Cushman

[57] ABSTRACT

A movable yoke-type lifting magnet device including a main core wound with a coil and at least one yoke magnetically coupled to the core. The movable mechanism of the yoke enables the yoke to freely follow the contour of a workpiece to be lifted. An auxiliary core may be provided between each said at least one yoke to provide a yoke-type lifting magnet device. The auxiliary core greatly increases the magnetic forces induced between the cores and the yoke. Combination of the magnetic coupling between the yokes and the core and the provision of the auxiliary core provides a movable yoke-type lifitng magnet device wherein the yoke can freely follow the contour of a workpiece and the magnetic forces between the cores and the yoke are greatly increased. Such a combination prevents the yoke from slipping relative to the cores and stable lifting is possible.

19 Claims, 4 Drawing Sheets

MOVABLE YOKE-TYPE LIFTING MAGNET DEVICE

BACKGROUND OF THE INVENTION

1. Field of the Invention

The present invention relates to a yoke-type lifting magnet device and, more particularly, relates to a movable yoke-type lifting magnet device.

2. Description of the Related Art

A yoke-type lifting magnet device is described in Japanese Utility Model Publication SHO No. 51-126570. The device has a pair of yokes mechanically and fixedly coupled to a core and each yoke includes a plurality of slidable pieces which are mechanically coupled to the yoke so as to slide vertically relative to the yoke when magnetic flux is not induced therein. Such a mechanical coupling for vertical movement needs a vertically extending hole formed in one member and a rod fixed to the other member penetrating the hole and therefore, the vertical movement of the slidable piece is limited by the length of the hole. As a result, the device can not freely follow the contour of a workpiece to be lifted.

To enable a yoke to freely follow the contour of a workpiece it might be effective to couple the yoke magnetically with the core, though such a magnetic coupling may cause slippage between the yoke and the core.

SUMMARY OF THE INVENTION

A first object of the present invention is to provide a movable yoke-type lifting magnet device wherein a yoke can move relative to a core more freely than in a mechanical coupling.

A second object of the present invention is to provide a yoke-type lifting magnet device wherein a magnetic force induced between a yoke and a core is greatly increased.

A third object of the present invention is to provide a movable yoke-type lifting magnet device wherein a yoke is magnetically coupled to a core so as to move relative to the core and the magnetic force induced between the core and the yoke is greatly increased thereby preventing the yoke from slipping relative to the core.

The first object can be attained by a movable yoke-type lifting magnet device in accordance with the present invention which comprises: (a) a core constructed of magnetic material and having first and second ends, (b) a coil wound around the core, and (c) at least one yoke magnetically coupled to each of the first and second ends of the core, respectively, each yoke having a first end adapted to magnetically couple with a workpiece to be lifted and a second end opposite the first end of the yoke with respect to the core, each yoke being slidable relative to the core toward and away from a workpiece.

The second object can be attained by a yoke-type lifting magnet device in accordance with the present invention which comprises: (a) a main core constructed of magnetic material and having first and second ends, (b) a coil wound around the main core, (c) at least one yoke magnetically coupled to each of the first and second ends of the main core, respectively, each yoke having a first end adapted to magnetically couple with a workpiece to be lifted and a second end opposite said first end of the yoke with respect to the main core, and (d) an auxiliary core magnetically coupled between the second end of each yoke.

The third object can be attained by a movable yoke-type lifting magnet device in accordance with the present invention which comprises: (a) a main core constructed of magnetic material and having first and second ends, (b) a coil wound around the main core, (c) at least one yoke magnetically coupled to each of the first and second ends of the main core, respectively, each yoke having a first end adapted to magnetically couple with a workpiece to be lifted and a second end opposite said first end of the yoke with respect to the core, each yoke being slidable relative to the core toward and away from a workpiece, and (d) an auxiliary core magnetically coupled between the second end of each yoke.

According to the above device corresponding to the first object, since the yoke is not mechanically but magnetically coupled to the core, the yoke can freely move relative to the core when magnetic force is not induced between the core and the yoke. Therefore, the device can follow the contour of a workpiece to be lifted more freely than in the conventional mechanical coupling. When an auxiliary core is provided as in the yoke-type lifting magnet device corresponding to the second object, the magnetic force induced between the cores and the yoke is greatly increased. When the magnetic coupling between the core and the yoke and the magnetic force increase due to the auxiliary core as in the movable yoke-type lifting magnet device corresponding to the third object, slippage between the cores and the yoke is effectively prevented even if a workpiece to be lifted is very heavy.

BRIEF DESCRIPTION OF THE DRAWINGS

The above and other objects, features and advantages of the present invention will become apparent and will be more readily appreciated from the following detailed description of the preferred exemplary embodiments of the invention taken in conjunction with the accompanying drawings, in which.

DETAILED DESCRIPTION OF THE PREFERRED EMBODIMENTS

Figure 1:
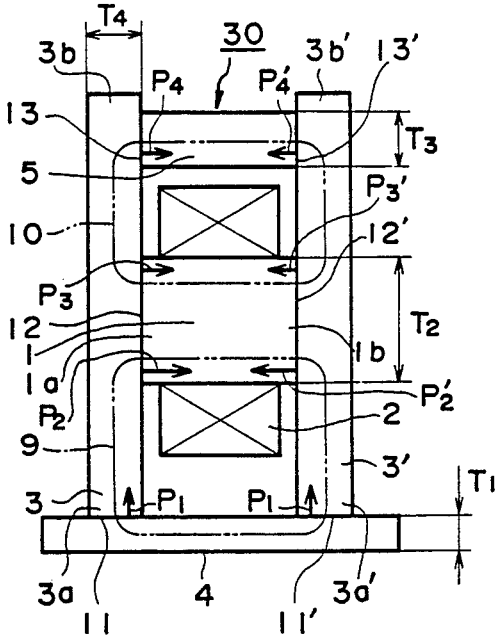
FIG. 1 is a basic, schematic elevational view of a yoke-type lifting magnet device in accordance with one embodiment of the present invention wherein an auxiliary core is provided.

First, a movable yoke-type lifting magnet device including no auxiliary core in accordance with one embodiment of the present invention will be explained referring to FIG. 6. A core 1 is constructed of magnetic material and has first and second ends. A coil 2 is wound around core 1 which is electrically connected to a power source (not shown). The device includes at least one yoke 3, 3'. Movable yokes 3 and 3' are not mechanically but magnetically coupled to each of the first and second ends of core 1, respectively. Each yoke 3, 3' has a first end adapted to magnetically couple with a workpiece 4 to be lifted and a second end opposite to the first end of the yoke with respect to core 1. Each yoke 3, 3' is slidable relative to core 1 toward and away from a workpiece when a magnetic force is not induced in yokes 3 and 3'. A magnetic flux path 9 induced in the device when an electric current flows in coil 2 and passes through core 1, one of movable yokes 3 and 3', workpiece 4 and the other of movable yokes 3 and 3' and produces magnetic forces $P_1$ and $P_1'$ at contact surfaces 11 and 11' between yokes 3 and 3' and workpiece 4, respectively, and magnetic forces $P_2$ and $P_2'$ at contact surfaces 12 and 12' between core 1 and yokes 3 and 3', respectively. Workpiece 4 is lifted by magnetic forces $P_1$ and $P_1'$ and is supported by the friction forces which are caused in proportion to forces $P_2$ and $P_2'$ between yokes 3 and 3' and core 1. In such a device, since yokes 3 and 3' can move independently of each other and relative to core 1, yokes 3 and 3' can follow substantially freely any contour of workpiece 4 without being mechanically limited.

When a workpiece 4 is so heavy that the friction forces between yokes 3 and 3' and core 1 are smaller than the magnetic forces $P_1$ and $P_1'$ induced between movable yokes 3 and 3' and workpiece 4, slippage will take place between movable yokes 3 and 3' and core 1. Such a slippage may deteriorate the supported attitude of workpiece 4 and, as a result, workpiece 4 may drop down from the lifting magnet device.

There are two ways to prevent such a slippage, one is to increase magnetic forces between the core and the yokes and the other is to increase friction forces between the two. The following embodiments of the present invention are directed to the former way as will be explained below.

Figure 2:
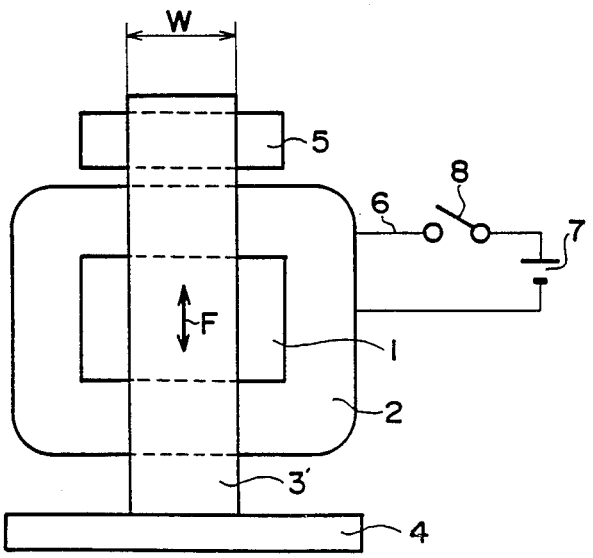
FIG. 2 is a side elevational view of the device of FIG. 1.

FIGS. 1 and 2 illustrate basic structures of a yoke-type lifting magnet device 30 in accordance with another embodiment of the present invention which includes an auxiliary core to increase a magnetic force induced between a core and a yoke. This embodiment illustrates how the magnetic flux induced between a main core and a yoke is increased. Device 30 includes a main core 1 constructed of magnetic material and including first and second longitudinal ends la and lb. A coil 2 is wound around main core 1 so as to produce a magnetic flux in core 1. Device 30 includes at least one yoke 3, 3'. Yokes 3 and 3' are constructed of magnetic material and are adapted so as to contact first and second ends 1*a* and 1*b* of core 1, respectively. Yokes 3 and 3' are magnetically coupled to first and second ends 1*a* and 1*b*, respectively, when core 1 is excited. Each yoke 3, 3' may be slidable or may not be slidable relative to main core 1 when core 1 is not excited. Each yoke 3, 3' extends at a right angle with respect to the longitudinal direction of core 1. Each yoke 3, 3' includes a first end 3*a*, 3*a*', respectively, adapted to magnetically couple with a workpiece 4 to be lifted and a second end 3*b*, 3*b*', respectively, opposite first end 3*a*, 3*a*' with respect to core 1. An auxiliary core 5 constructed of magnetic material is inserted between second ends 3*b* and 3*b*' of the yokes 3 and 3' so as to be magnetically coupled to second ends 3*b* and 3*b*' when core 1 is excited. Auxiliary core 5 is mechanically coupled to main core 1 so as to be in fixed relationship to core 1. Lifting magnet device 30 is lifted by lifting one of cores 1 and 5. Coil 2 is electrically coupled via an electrical circuit 6 including a switch 8 to a D.C. source 7.

When an electric current flows in coil 2, two magnetic flux paths 9 and 10 are induced in device 30. Flux path 9 passes through main core 1, one of yokes 3 and 3', workpiece 4 and the other of yokes 3 and 3'. Flux path 10 passes through main core 1, one of yokes 3 and 3', auxiliary core 5 and the other of yokes 3 and 3'. Flux path 9 causes magnetic forces $P_1$ and $P_1'$ at contact surfaces 11 and 11' between yokes 3 and 3' and workpiece 4, respectively, and magnetic forces $P_2$ and $P_2'$ at contact surfaces 12 and 12' between yokes 3 and 3' and main core 1, respectively. Flux path 10 causes magnetic forces $P_3$ and $P_3'$ at contact surfaces 12 and 12' between yokes 3 and 3' and main core 1, respectively, and magnetic forces $P_4$ and $P_4'$ at contact surfaces 13 and 13' between yokes 3 and 3' and auxiliary core 5, respectively. Magnetic forces $P_2$, $P_2'$, $P_3$, $P_3'$, $P_4$ and $P_4'$ act horizontally and cause vertically acting friction forces in proportion to the magnetic forces induced at contact surfaces 12, 12', 13 and 13' when workpiece 4 is lifted. In this instance, the friction coefficient is usually 0.15–0.2. When these friction forces are larger than the weight of workpiece 4, workpiece 4 can be lifted without causing slippage between cores 1 and 5 and yokes 3 and 3'.

When the thickness $T_2$ of main core 1 is greater than the sum of the thickness $T_1$ of workpiece 4 and the thickness $T_3$ of auxiliary core 5, main core 1 has a sufficient cross-section to allow flux path 9 to be fully induced without being restricted by flux path 10. When the dimensional relationship of $T_2>(T_1+T_3)$ holds, workpiece 4 and auxiliary core 5 can be magnetically saturated when main core 1 is magnetically excited. As a result, workpiece 4 can be effectively lifted. Hence, the above dimensional relationship should hold. In this instance, since a perfect magnetic saturation is not obtained with an iron core, $T_2$ is preferably greater than (1.5–2) ( $T_1+T_3$).

Figure 6:
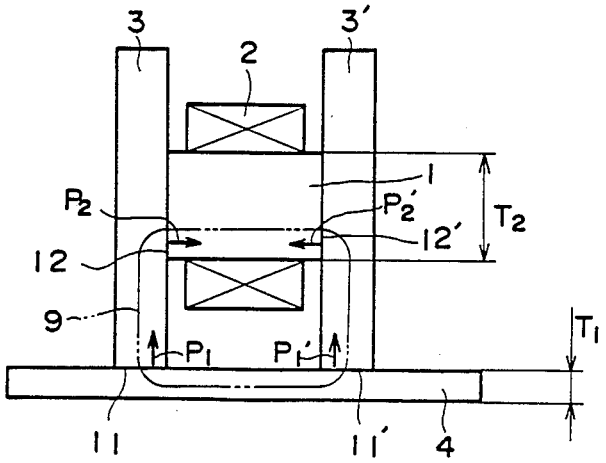
FIG. 6 is a basic, schematic elevational view of a movable yoke-type lifting magnet device in accordance with yet another embodiment of the present invention.

Due to the provision of auxiliary core 5, the magnetic coupling forces acting on movable yokes 3 and 3' are increased from $(P_2+P_2')$ with the device shown in FIG. 6 to $(P_2+P_2')+(P_3+P_3')+(P_4+P_4')$ with device 30 shown in FIGS. 1 and 2. As a result, the friction forces between cores 1 and 5 and yokes 3 and 3' are greatly increased. The degree of the increase in the magnetic forces will be more particularly discussed below. When the saturation flux density $B_s$ of workpiece 4 and auxiliary core 5 is, for example, 2 (T), (where T is tesla, a unit of flux density) and the width of each yoke 3, 3' is W, the flux $\Phi_W$ passing through workpiece 4 is $2T_1W$ and the flux $\phi_A$ passing through auxiliary core 5 is $2T_3W$. Usually, magnetic force f can be calculated by the following equation:

$$f=(1/(2\ m_0))(\phi^2/S)$$

where:

$m_0$ is a permeability in vacuum;

$\Phi$ is a magnetic flux; and

S is a cross-sectional area.

Thus, the magnetic force $P_4$ induced between auxiliary core 5 and each yoke 3, 3' and the magnetic force $(P_2+P_3)$ induced between main core 1 and each yoke 3, 3' can be expressed by the following equations (1) and (2), respectively:

$$P_4 = (1/(2m_0))((2T_3W)^2/(T_3W)) = (2T_3W)/m_0 \quad (1)$$

$$P_2 + P_3 = (1/(2m_0))((2T_3W + 2T_1W)^2/(T_2W)) = (2W(T_3 + T_1)^2)/(m_0T_2) \quad (2)$$

On the other hand, when an auxiliary core is not provided as in FIG. 6, the magnetic force includes only $P_2$ and it can be expressed as the following equation (3):

$$P_2 = (1/(2m_0))((2T_1W)^2/(T_2W)) = (2T_1^2W)/m_0T_2 \quad (3)$$

Due to the provision of auxiliary core 5, the magnetic force is increased from $P_2$ obtained by equation (3) to $(P_2+P_3+P_4)$ obtained from the summation of equations (1) and (2). When, for example, $T_2$ is 38 mm, $T_1$ is 3.2 mm, and $T_3$ is 14 mm, $(P_2+P_3+P_4)$ obtained from the summation of equations (1) and (2) is 21.79 and $P_2$ obtained from equation (3) is 0.27. This means that the provision of auxiliary core 5 increases the magnetic force with the device of FIGS. 1 and 2 by so great as about eighty times that with the device of FIG. 6. As a result, the friction forces between cores 1 and 5 and yokes 3 and 3' are greatly increased, because the friction forces are proportion to the magnetic forces.

Next, preferable dimensional relationships as to each yoke 3, 3' and contact surfaces 11 and 11' between movable yokes 3 and 3' and workpiece 4 will be discussed. In order that mechanical strength be increased and magnetic resistance be reduced, the thickness $T_4$ of each yoke 3, 3' is required to be larger than the thickness $T_1$ of workpiece 4. The magnetic force $P_1$ at each contact surface 11, 11' is obtained from the following equation:

$$P_1=(1/(2\ m_0))\ (\phi_9^2/S_{11})$$

where:

$m_0$ is a permeability in vacuum;

$\phi_9$ is a magnetic quantity of flux path 9; and $S_{11}$ is an area of contact surface 11.

Figure 3:
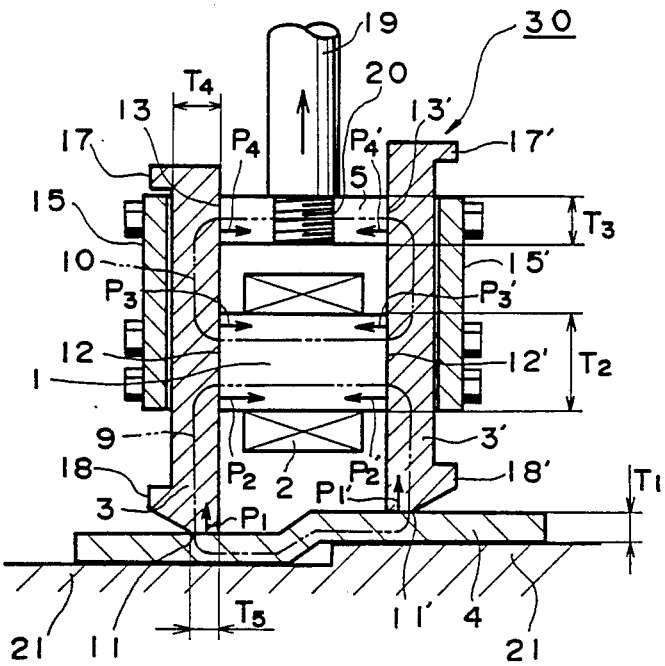
FIG. 3 is a sectional view of a movable yoke-type lifting magnet device according to another embodiment of the present invention wherein an auxiliary core is provided and a yoke is movable relative to a main core and the auxiliary core.

When the length of surface 11 in the longitudinal direction of core 1 which may not be equal to $T_4$ as shown in FIG. 3 is $T_5$, $\Phi_9$ is $2T_1W$ and $S_{11}$ is $T_5W$. Thus, the magnetic force $P_1$ can be obtained by the following equation:

$$P_1 = (1/(2m_0))((2T_1W)^2/(T_5W)) = (2W(T_1)^2)/(m_0T_5)$$

When the thickness $T_1$ of workpiece 4 is constant, magnetic force $P_1$ is in inverse proportion to $T_5$. When workpiece 4 is thin and of large area and, hence, each contact surface 11, 11' is of large area, the magnetic force may be insufficient to lift a workpiece. In such a case, lower end portions of yokes 3 and 3' can be made narrow to obtain small contact surface and large magnetic forces $P_1$ and $P_1'$, though $T_5$ must be maintained larger than $T_1$ even in such a small contact surface. This is because the magnetic flux will be saturated not at workpiece 4 but at contact surfaces 11 and 11' if $T_5$ was smaller than $T_1$.

Figure 4:
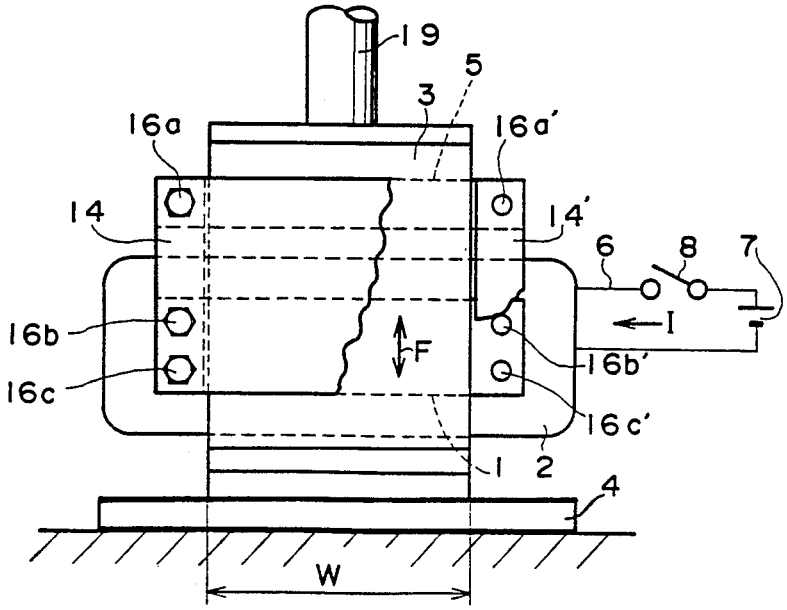
FIG. 4 is a partially broken, side elevational view of the device of FIG. 3.

FIGS. 3 and 4 illustrate a movable yoke-type lifting magnet device in accordance with yet another embodiment of the present invention wherein an auxiliary core is provided and a yoke is movable relative to a main core. The forgoing explanations with respect to the device of FIGS. 1 and 2 are also applicable to the device of this embodiment except that the yoke of this embodiment must be freely slidable relative to the main and auxiliary cores when the main core is not excited. In FIGS. 3 and 4, main core 1 and auxiliary core 5 are constructed of soft magnetic material such as iron. Coil 2 wound around core 1 is constructed of a copper wire sheathed with an enamel. Workpiece 4 to be lifted is an iron plate which may have a step. Such a step can be absorbed by independent movement between yokes 3 and 3'. Main core 1 and auxiliary core 5 are fixedly and mechanically coupled by connecting bars 14 and 14' which are constructed of nonmagnetic material such as stainless steel. Connecting bars 14 and 14' are preferably covered with covers 15 and 15', respectively, which are constructed of nonmagnetic material such as stainless steel (SUS 304). Connecting bars 14 and 14' and covers 15 and 15' are fixed to cores 1 and 5 by bolts 16*a*, 16*b* and 16*c*. Bolts 16*a*, 16*b* and 16*c* penetrate bolt holes formed in the end portions of covers 15 and are threaded to tapped holes formed in the end portions of cores 1 and 5. In FIG. 4, reference numeral 16*a*' illustrates one of the bolt holes corresponding to bolt 16*a* and reference numerals 16*b*' and 16*c*' illustrate some of the tapped holes corresponding to bolts 16*b* and 16*c*, respectively. When core 1 is not magnetically excited, yokes 3 and 3' can freely, independently of each other, move in the space defined by cores 1 and 5, connecting bars 14 and 14' and covers 15 and 15'. Movable yokes 3 and 3' can move toward and away from a workpiece 4 to be lifted, that is, in the direction of arrow F in FIG. 4. Lowermost portions of yokes 3 and 3' where workpiece 4 is to be magnetically coupled to yokes 3 and 3' are made narrow as was discussed in the foregoing. Preferably, to limit movements of yokes 3 and 3' to predetermined strokes, yokes 3 and 3' include outwardly protruding upper stoppers 17 and 17' at the upper portions thereof, respectively, and outwardly protruding lower stoppers 18 and 18' at the lower portions thereof, respectively. Lifting rod 19 is connected to auxiliary core 5 by threads 20. Lifting rod 19 is connected to a conveyer device (not shown) for conveying device 30.

Figure 5:
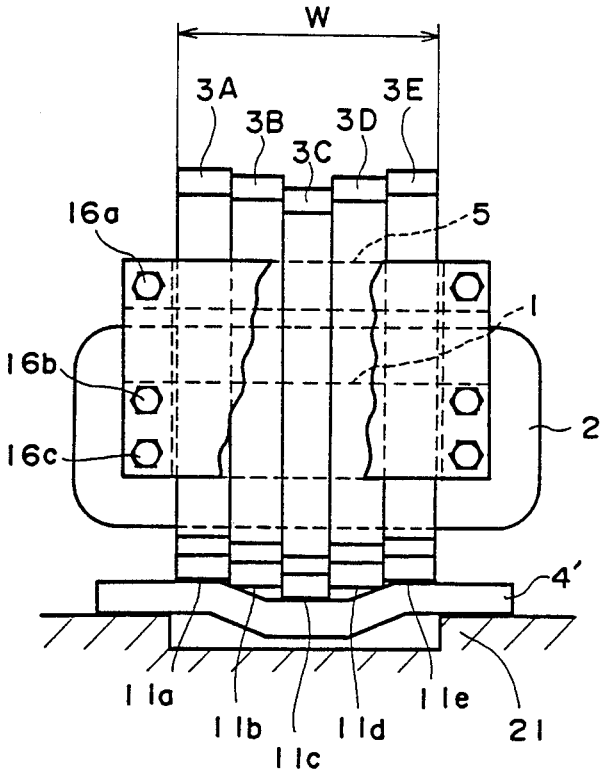
FIG. 5 is a partially broken, side elevational view of one alteration of the device of FIG. 3.

FIG. 5 illustrates a movable yoke-type lifting magnet device corresponding to one alteration of the device of FIGS. 3 and 4. In FIG. 5, yokes include a plurality of yokes. More particularly, yoke 3 of FIG. 3 includes a plurality of yokes 3A, 3B, 3C, 3D and 3E of FIG. 5 which are arranged side by side and slidably contact each other. Thus, yokes 3A to 3E can move independently relative to each other in the vertical direction. The other yoke of FIG. 5 corresponding to yoke 3' of FIG. 3 should include a plurality of yokes in the same manner as the yoke of FIG. 5 corresponding to yoke 3 of FIG. 3. These yoke structures including a plurality of yokes enable the yokes to follow the contour of workpiece 4' mounted on table 21. More particularly, in FIG. 5, contact surfaces 11*a*, 11*c* and 11*e* substantially entirely contact workpiece 4' and effective magnetic coupling can be obtained. However, surfaces 11*b* and 11*d* do not contact workpiece 4' and effective coupling will not be obtained. Using a plurality of yokes will decrease the areas of such non-contact surfaces. Since these yokes slidingly contact each other, it is desirable that the contact surfaces be hardened by suitable means such as chrome plating, nitriding or nickel-phosphorus electroless plating and that lubrication be coated on the contact surfaces. Since provision of auxiliary core 5 increases remanence, it is desirable to provide a countermeasure for remanence. More particularly, as a mechanical countermeasure, it is desirable to provide spring means for biasing the yokes in the direction away from cores 1 and 5 or to insert thin nonmagnetic plates between cores 1 and 5 and the yokes. As an electrical countermeasure, when a workpiece which has been magnetically coupled is to be relieved from the coupling, it is desirable to inversely excite core 1 for a very short period of time and then cut the electric current flowing in coil 2 when the remanence approaches zero.

Figure 7:
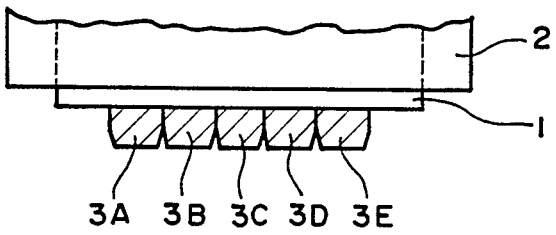
FIG. 7 is a transverse, partial cross-sectional view of a portion in the vicinity of the yoke of another alteration of the device of FIG. 3.

FIG. 7 illustrates another alteration of the embodiment of FIG. 3. In FIG. 7, each yoke 3A, 3B, 3C, 3D, 3E has partially tapered side surfaces. The side surfaces are tapered, from a mid-portion to an outside end of each yoke in the longitudinal direction of core 1, so as to make the width of each yoke gradually narrow toward the outside end. These partially tapered surfaces of each yoke decrease the contact surfaces between the yokes 3A, 3B, 3C, 3D and 3E which are arranged side by side and help each yoke move more smoothly and more independently of the adjacent yokes than in a device provided with a yoke having no partially tapered side surfaces.

As will be apparent from the foregoing, the following effects can be obtained according to the present invention:

First, when yokes 3 and 3' are magnetically coupled to core 1 as was illustrated in the embodiment corresponding to FIG. 6, yokes 3 and 3' can follow substantially more freely the contour of a workpiece to be lifted than in a conventional device having a mechanical coupling between a core and a yoke.

Second, when auxiliary core 5 is provided as was illustrated in the embodiment corresponding to FIGS. 1 and 2, magnetic coupling forces induced between yokes 3 and 3' and cores 1 and 5 are greatly increased.

Third, when auxiliary core 5 is provided and yokes 3 and 3' are magnetically coupled to main core 1 and auxiliary core 5 as was illustrated in the embodiment corresponding to FIGS. 3 and 4, yokes 3 and 3' can freely move relative to cores 1 and 5 when the device is not excited and no slippage takes place between the yokes and the cores, whereby stable lifting is obtained.

Fourth, when each yoke 3, 3' includes a plurality of yokes as was illustrated in the embodiment corresponding to FIG. 5, yoke 3, 3' can follow the contour of a workpiece 4, 4' in the direction at a right angle with respect to the longitudinal direction of core 1 as well as in the direction of the longitudinal direction of core 1.

Finally, when each yoke 3A, 3B, 3C, 3D and 3E has partially tapered side surfaces, sliding between the yokes is very smooth.

Although only several embodiments of the present invention have been described in detail, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A yoke-type lifting magnet device comprising:

a main core constructed of magnetic material and having first and second ends;

a coil wound around said main core;

at least one yoke magnetically coupled to each of said first and second ends of said main core, respectively, each said yoke having a first end adapted to magnetically couple with a workpiece to be lifted and a second end opposite said first end of said yoke with respect to said main core, said main core, said yoke provided at said first end of said main core, said workpiece, and said yoke provided at said second end defining a first magnetic flux path when said main core is magnetically excited; and an auxiliary core magnetically coupled between said second end of each said yoke, said main core, said yoke provided at said first end of said main core, said auxiliary core, and said yoke provided at said second end of said main core defining a second magnetic flux path when said main core is magnetically excited, wherein said first and second magnetic flux paths are parallel to each other, thereby forming a magnetic flux path circuit.

2. A movable yoke-type lifting magnet device comprising:

a main core constructed of magnetic material and having first and second ends;

a coil wound around said main core;

at least one yoke magnetically coupled to each of said first and second ends of said main core, respectively, each said yoke having a first end adapted to magnetically couple with a workpiece to be lifted and a second end opposite said first end of said yoke with respect to said main core, each said yoke being slidable relative to said main core toward and away from a workpiece, said main core, said yoke provided at said first end of said main core, said workpiece, and said yoke provided at said second end defining a first magnetic flux path when said main core is magnetically excited; and an auxiliary core magnetically coupled between said second end of each said yoke, said main core, said yoke provided at said first end of said main core, said auxiliary core, and said yoke provided at said second end of said main core defining a second magnetic flux path when said main core is magnetically excited, wherein said first and second magnetic flux paths are parallel to each other, thereby forming a magnetic flux path circuit.

3. The device as in claim 1 or claim 2, wherein the following relationship holds among a workpiece to be lifted, said main core and said auxiliary core:

$$T_2 > (T_1 + T_3)$$

where, $T_1$ is a thickness of said workpiece;

$T_2$ is a thickness of said main core; and $T_3$ is a thickness of said auxiliary core.

4. The device as in claim 3, wherein the following relationship holds:

$$T_2 > (1.5-2)\,(T_1 + T_3).$$

5. The device as in claim 1 or claim 2, wherein the following relationship holds between said at least one yoke and a workpiece to be lifted:

$$T_4 > T_1$$

where, $T_1$ is a thickness of said workpiece; and $T_4$ is a thickness of the portions of said at least one yoke where said at least one yoke magnetically couples with said main and auxiliary cores.

6. The device as in claim 5, wherein said at least one yoke each is narrowed at its said first end and the following relationships hold between said at least one yoke and a workpiece to be lifted:

$$T_5 < T_4, \text{ and}$$

$$T_5 > T_1$$

where, $T_5$ is a thickness of said narrowed first end of said at least one yoke.

7. The device as in claim 1 or claim 2, wherein said main and auxiliary cores are coupled to each other so as to be in fixed relationship relative to each other.

8. The device as in claim 2, further comprising a connecting bar constructed of nonmagnetic material and extending between said main and auxiliary cores and wherein said connecting bar connects said main and auxiliary cores.

9. The device as in claim 8, further comprising a cover constructed of nonmagnetic material and extending along said connecting bar, said cover covering the outside surface of said connecting bar, each said yoke being contained between said main core and said cover.

10. The device as in claim 1 or claim 2, further comprising a lifting rod adapted to be coupled to a conveyer device for conveying said lifting magnet device and wherein said lifting rod is mechanically coupled to at least one of said auxiliary core and said main core.

11. The device as in claim 2, wherein each said at least one yoke includes a plurality of yokes arranged side by side so as to be slidable independently of each other.

12. The device as in claim 2, wherein contact surfaces between said at least one yoke and said main and auxiliary cores are hardened by one of chrome plating, nitriding and nickel-phosphorus electroless plating.

13. The device as in claim 2, wherein spring means for biasing said at least one yoke in the direction away from said main and auxiliary cores is provided between said at least one yoke and said main and auxiliary cores.

14. The device as in claim 2, wherein thin nonmagnetic plates are inserted between said at least one yoke and said main and auxiliary cores.

15. The device as in claim 2, further comprising electric source means electrically connected to said coil and wherein said electric source means is adapted so as to magnetically excite said main core inversely for a very short period of time when a workpiece which has been magnetically coupled to said at least one yoke is to be relieved from the magnetic coupling and then cut the electric current flowing in said coil when the remanence approaches zero.

16. The device as in claim 11, wherein each said plurality of yokes arranged side by side has side surfaces which are partially tapered from a mid-portion toward an outside end of said each yoke so as to make the width of said each yoke gradually narrow toward said outside end.

17. A yoke-type lifting magnet device comprising:

a main core constructed of magnetic material and having first and second ends;

a coil wound around said main core;

at least one yoke magnetically coupled to each of said first and second ends of said main core, respectively, each said yoke having a first end adapted to magnetically couple with a workpiece to be lifted and a second end opposite said first end of said yoke with respect to said main core, said main core, said yoke provided at said first end of said main core, said workpiece, and said yoke provided at said second end defining a first magnetic flux path when said main core is magnetically excited;

an auxiliary core magnetically coupled between said second end of each said yoke, said main core, said yoke provided at said first end of said main core, said auxiliary core, and said yoke provided at said second end of said main core defining a second magnetic flux path when said main core is magnetically excited, wherein said first and second magnetic flux paths are parallel to each other, thereby forming a magnetic flux path circuit; and stopping means for stopping said yokes from sliding along said main core beyond a predetermined distance.

18. A movable yoke-type lifting magnet device comprising:

a main core constructed of magnetic material and having first and second ends;

a coil wound around said main core;

at least one yoke magnetically coupled to each of said first and second ends of said main core, respectively, each said yoke having a first end adapted to magnetically couple with a workpiece to be lifted and a second end opposite said first end of said yoke with respect to said main core, each said yoke being slidable relative to said main core toward and away from a workpiece, said main core, said yoke provided at said first end of said main core, said workpiece, and said yoke provided at said second end defining a first magnetic flux path when said main core is magnetically excited;

an auxiliary core magnetically coupled between said second end of each said yoke, said main core, said yoke provided at said first end of said main core, said auxiliary core, and said yoke provided at said second end of said main core defining a second magnetic flux path when said main core is magnetically excited, wherein said first and second magnetic flux paths are parallel to each other, thereby forming a magnetic flux path circuit;

a connecting bar constructed of nonmagnetic material and extending between said main and auxiliary cores and wherein said connecting bar connects said main and auxiliary cores;

a cover constructed of nonmagnetic material and extending along said connecting bar, said cover covering the outside surface of said connecting bar, each said yoke being contained between said main core and said cover; and wherein said at least one yoke each includes first and second stoppers protruding outwardly at said first and second ends of said yoke, respectively, said first and second stoppers hitting said cover when said at least one yoke moves relative to said main and auxiliary cores more than a predetermined stroke thereby limiting movement of said at least one yoke relative to said main and auxiliary cores less than said predetermined stroke.

19. A movable yoke-type lifting magnet device comprising:

a main core constructed of magnetic material and having first and second ends;

a coil wound around said main core;

at least one yoke magnetically coupled to each of said first and second ends of said main core, respectively, each said yoke having a first end adapted to magnetically couple with a workpiece to be lifted and a second end opposite said first end of said yoke with respect to said main core, each said yoke being slidable relative to said main core toward and away from a workpiece, said main core, said yoke provided at said first end of said main core, said workpiece, and said yoke provided at said second end defining a first magnetic flux path when said main core is magnetically excited;

an auxiliary core magnetically coupled between said second end of each said yoke, said main core, said yoke provided at said first end of said main core, said auxiliary core, and said yoke provided at said second end of said main core defining a second magnetic flux path when said main core is magnetically excited, wherein said first and second magnetic flux paths are parallel to each other, thereby forming a magnetic flux path circuit; and stopping means for stopping said yokes from sliding along said main core beyond a predetermined distance.

* * * * *